US007665218B1

(12) United States Patent
Pinto

(10) Patent No.: US 7,665,218 B1
(45) Date of Patent: Feb. 23, 2010

(54) AZIMUTH MEASURING APPARATUS AND METHOD

(75) Inventor: Robert P. Pinto, Dover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 55 days.

(21) Appl. No.: 12/055,533

(22) Filed: Mar. 26, 2008

Related U.S. Application Data

(60) Provisional application No. 60/915,283, filed on May 1, 2007.

(51) Int. Cl.
*G01C 1/00* (2006.01)
*G01C 15/10* (2006.01)
*F41G 1/00* (2006.01)

(52) U.S. Cl. ..... 33/333; 33/282; 33/283; 33/392; 42/134; 89/41.19

(58) Field of Classification Search ..... 33/333, 33/334, 339, 343, 369, 370, 371, 374, 375, 33/391–393, 304, 308, 313, 520, 544, 613, 33/644, 645, 282, 283; 89/41.19, 200; 42/134
See application file for complete search history.

(56) References Cited

U.S. PATENT DOCUMENTS

| | | | | | |
|---|---|---|---|---|---|
| 803,435 | A | * | 10/1905 | Saegmuller | 359/399 |
| 1,824,321 | A | * | 9/1931 | Baker | 33/371 |
| 2,364,055 | A | * | 12/1944 | Berry | 33/333 |
| 2,367,288 | A | * | 1/1945 | Finke et al. | 89/200 |
| 2,669,024 | A | * | 2/1954 | Flanagan | 89/200 |
| 3,256,608 | A | * | 6/1966 | Neisius | 33/228 |
| 4,026,190 | A | * | 5/1977 | Blair | 89/41.17 |
| 4,306,806 | A | * | 12/1981 | Barron | 356/138 |
| 4,709,614 | A | * | 12/1987 | Klumpp | 89/1.35 |
| 5,020,231 | A | * | 6/1991 | Huynh | 33/203.18 |
| 5,225,626 | A | * | 7/1993 | Bowers | 89/41.19 |
| 5,799,405 | A | * | 9/1998 | Christensen et al. | 33/392 |

* cited by examiner

*Primary Examiner*—Amy Cohen Johnson
(74) *Attorney, Agent, or Firm*—John F. Moran

(57) ABSTRACT

An apparatus for measuring the azimuth of a tube having a bore axis includes a centering mandrel having a longitudinal axis; a flexible member for defining a bore axis projection of the bore axis; a tensioner fixed to one end of the flexible member, and a pair of adjusters connected to the tensioner, the adjusters for moving the tensioner along a respective pair of axes that are perpendicular to the bore axis projection, the axes of the adjusters being mutually perpendicular.

17 Claims, 4 Drawing Sheets

AZIMUTH MEASURING APPARATUS AND METHOD

CROSS-REFERENCE TO RELATED APPLICATIONS

This application claims the benefit under 35 USC 119(e) of U.S. provisional patent application No. 60/915,283 filed on May 1, 2007, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to measuring devices and in particular to devices for measuring azimuth.

Verifying the pointing accuracy of an artillery cannon, mortar tube, or other equipment in an engineering environment has been and continues to be a problem. A theodolite has been used to measure the azimuth of an artillery cannon, mortar tube, or other equipment. U.S. Pat. No. 5,225,626 issued on Jul. 6, 1993 to Bowers discloses another arrangement for measuring the azimuth of a tube.

Shortcomings of these approaches are the inability to quantify or calibrate the apparatus and to establish or remove bias from the measurement. Additionally, the use of an optical instrument, such as a theodolite, to align to a projection of a tube axis is a subjective process and highly dependent upon the skill of the theodolite operator.

SUMMARY OF THE INVENTION

It is an object of the invention to provide a method and apparatus for measuring the azimuth of a tube.

A first aspect of the invention is an apparatus for measuring the azimuth of a tube having a bore axis, the apparatus comprising a centering mandrel having a longitudinal axis; a flexible member for defining a bore axis projection of the bore axis; a tensioner fixed to one end of the flexible member, the tensioner including a support point for the flexible member, the support point lying on a longitudinal axis of the centering mandrel; a support structure comprising bottom and top plates connected with support members, the tensioner being fixed to the top plate, the centering mandrel being fixed to the bottom plate; another end of the flexible member being fixed to the bottom plate at a point where the longitudinal axis of the centering mandrel intersects the bottom plate; and a pair of adjusters connected to the tensioner, the adjusters for moving the tensioner along a respective pair of axes that are perpendicular to the bore axis projection, the respective pair of axes of the adjusters being mutually perpendicular.

A second aspect of the invention is a method of measuring the azimuth of a tube having a bore axis, the method comprising providing the apparatus of the first aspect of the invention; inserting the centering mandrel into the tube; using one's eye, determining a circumferential location around the apparatus wherein the flexible member appears vertical; measuring the azimuth from the circumferential location to the tube; and determining the azimuth of the tube by adding 180 degrees to or subtracting 180 degrees from the azimuth measured from the circumferential location to the tube.

The method may include calibrating the apparatus before inserting the central mandrel into the tube.

Calibrating the apparatus may include inserting the centering mandrel into a tube having a known angle of elevation; viewing the flexible member with an optical instrument; using the adjusters, moving the flexible member to coincide with the known angle; rotating the apparatus 180 degrees in the vertical tube; viewing the flexible member with the optical instrument; and for a second time, using the adjusters to move the flexible member to coincide with the known angle.

A third aspect of the invention is an apparatus according to the first aspect of the invention and further including a second flexible member and a plumb bob, the second flexible member being attached at one end to the tensioner and at another end to the plumb bob.

A fourth aspect of the invention is a method of measuring the azimuth of a tube having a bore axis, the method comprising providing the apparatus of the third aspect of the invention; inserting the centering mandrel into the tube; using one's eye, determining a circumferential location around the apparatus wherein the first and second flexible members coincide; measuring the azimuth from the circumferential location to the tube; and determining the azimuth of the tube by adding 180 degrees to or subtracting 180 degrees from the azimuth measured from the circumferential location to the tube.

A fifth aspect of the invention is a method of measuring the azimuth of a tube having a bore axis, the method comprising providing the apparatus of the first aspect of the invention; inserting the centering mandrel into the tube; using an optical instrument having a vertical reference reticle, determining a circumferential location around the apparatus wherein the flexible member coincides with the vertical reference reticle; measuring the azimuth from the circumferential location to the tube; and determining the azimuth of the tube by adding 180 degrees to or subtracting 180 degrees from the azimuth measured from the circumferential location to the tube.

The fifth aspect may further comprise, after determining the azimuth of the tube, rotating the apparatus 180 degrees in the tube; using the optical instrument having the vertical reference reticle, determining a second circumferential location around the apparatus wherein the flexible member coincides with the vertical reference reticle; measuring the azimuth from the second circumferential location to the tube; determining a second azimuth of the tube by adding 180 degrees to or subtracting 180 degrees from the azimuth measured from the second circumferential location to the tube; and averaging the azimuth and the second azimuth.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention is useful, for example, for measuring the azimuth of an artillery cannon, mortar gun tube, or other equipment. The inventive apparatus can be inexpensively fabricated, its calibration may be easily verified, and if needed, it may be re-calibrated in a field environment. The only critical tolerances are associated with the centering mandrel being able to accurately locate the centerline of the bore axis, and the attachment point of the bore axis projection member to the mandrel. The external portions of the invention may be constructed to lesser tolerances, with the major requirement being that it remains as rigid as possible to minimize flexing and thereby minimize the need for recalibration.

One advantage of the invention over the Bowers device described in U.S. Pat. No. 5,225,626 is that the invention may be rotated 180 degrees. Rotating the fixture through 180 degrees and then viewing the fixture allows misalignment of the bore axis projection member to be quantified and/or removed by means of an adjustment mechanism. Another advantage over the Bowers device is that the bore axis projection member may be used without the need for a plumb bob.

Figure 1:
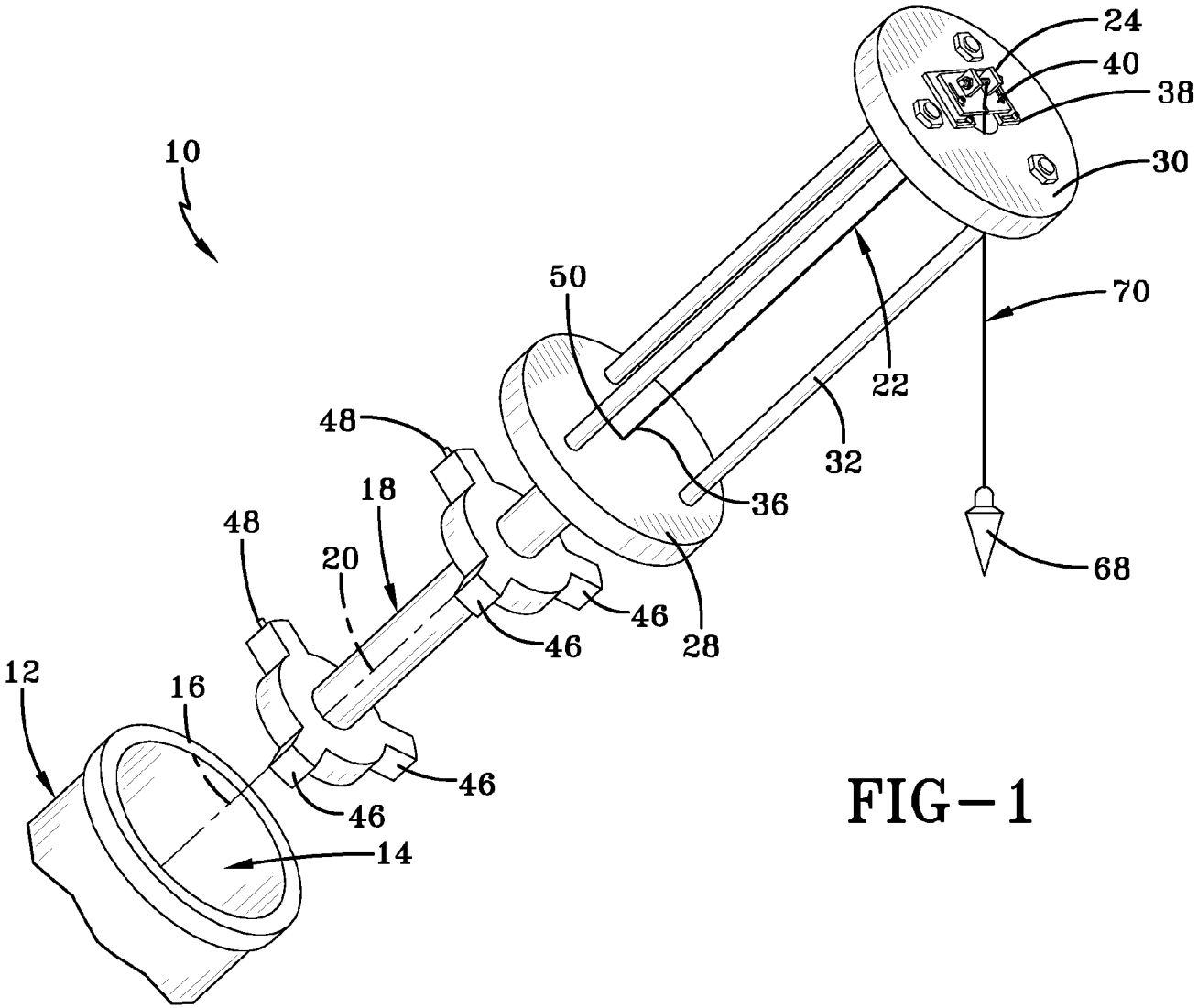
FIG. 1 is a perspective view of one embodiment of the invention in relation to a bore.

FIG. 1 shows an apparatus 10 for measuring the azimuth of a tube 12 having a bore 14. Bore 14 has a bore axis 16. Tube 12 may be any type of tube and is not limited to munitions. Apparatus 10 includes a centering mandrel 18 having a longitudinal axis 20. The projection of the bore axis 16 outside of the bore 14 is defined by a flexible member 22. Flexible member 22 may be, for example, a fine cord, string or filament. A tensioner 24 (FIG. 3) is fixed to one end 34 of the flexible member 22.

Figure 2:
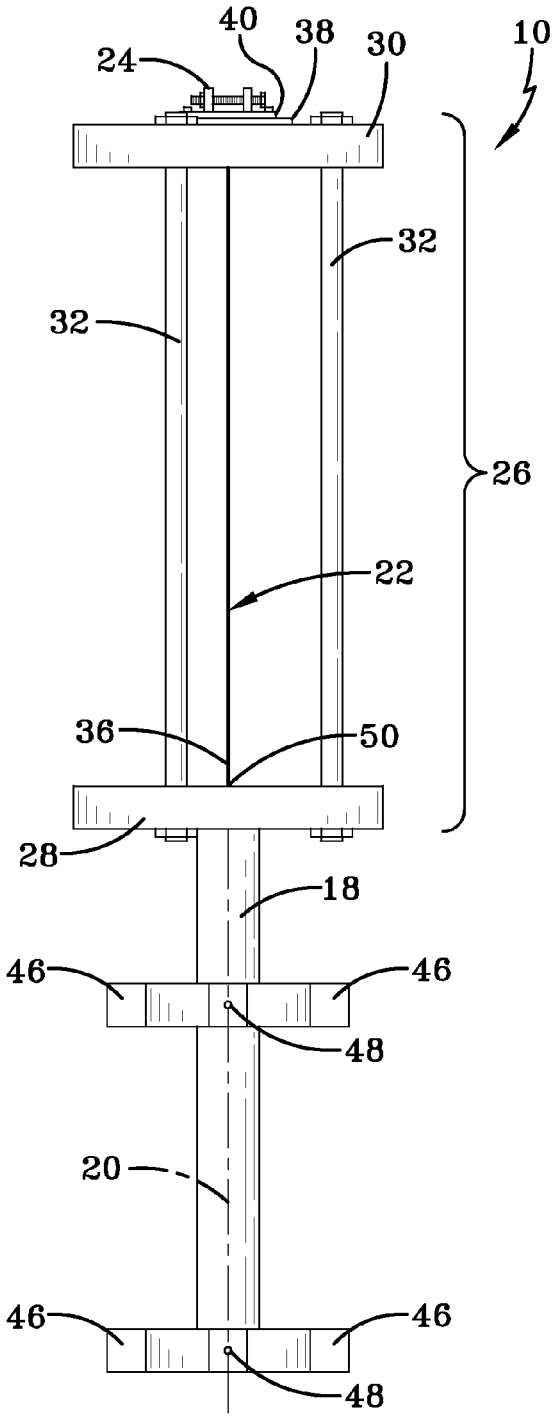
FIG. 2 is a rear view of FIG. 1.

Apparatus 10 further includes a support structure 26 (FIG. 2) comprising bottom and top plates 28, 30 connected with support members 32. The tensioner 24 is fixed to the top plate 30. The centering mandrel 18 is fixed to the bottom plate 28. Another end 36 of the flexible member 22 is fixed to the bottom plate 28 at a point where the longitudinal axis 20 of the centering mandrel 18 intersects the bottom plate 28. A pair of adjusters 38, 40 (FIG. 3) are connected to the tensioner 24 for moving the tensioner 24 along a respective pair of axes 42, 44 that are perpendicular to the bore axis projection. The axes 42, 44 of the adjusters 38, 40 are mutually perpendicular.

The centering mandrel 18 is centered in bore 14. The mandrel 18 comprises a plurality of fixed lobes 46, arranged radially from the longitudinal axis 20 of the mandrel 18. Preferably, at least three lobes 46 are present at a single axial position on the longitudinal axis 20. The lobes 46 contact the interior bore wall and are dimensioned such that they center the mandrel 18 and align it with the bore axis 16. At least the portion of the lobe 46 that contacts the interior bore wall may be made of a non-marring material, such as brass. The non-marring material will not score the interior bore wall. The portion of the lobe 46 comprising the non-marring material may be made removable from the remainder of the lobe to facilitate fabrication.

Tubes 12 with different inside diameters may require different size lobes 46. The lobes 46 may be removably fixed to the mandrel 18 with, for example, set screws (not shown). One or more lobes 46 may include a spring 48 (or spring-loaded plunger) that contacts the interior wall of the bore so that the spring force maintains contact of the fixed lobes 46 with the bore wall. Preferably, a second set of lobes 46 are included at a location that is axially displaced from the first set of lobes 46 to thereby maintain the axis 20 of the mandrel 18 coaxial with the bore axis 16.

Centering mandrel 18 supports the bottom plate 28. The support members 32 extend from the bottom plate 28 to the top plate 30. Support members 32 are roughly parallel to the axis 20 of the mandrel 18. The bottom plate 28 contains a unique point 50 that lies on the axis 20 of the mandrel 18 and on the bore axis 16. From this unique point 50, one end 36 of flexible member 22 is attached. Flexible member 22 extends to the top plate 30. The top plate 30 supports the adjustment mechanisms 38, 40. Adjustment mechanisms 38, 40 may be used to regulate the position of the member 22 in two orthogonal axes 42, 44 that are mutually perpendicular to the bore axis 16 and to each other. The adjustment mechanisms 38, 40 permit alignment of the member 22 with the projection of the bore axis 16. This alignment allows one to calibrate the apparatus 10.

Figure 3:
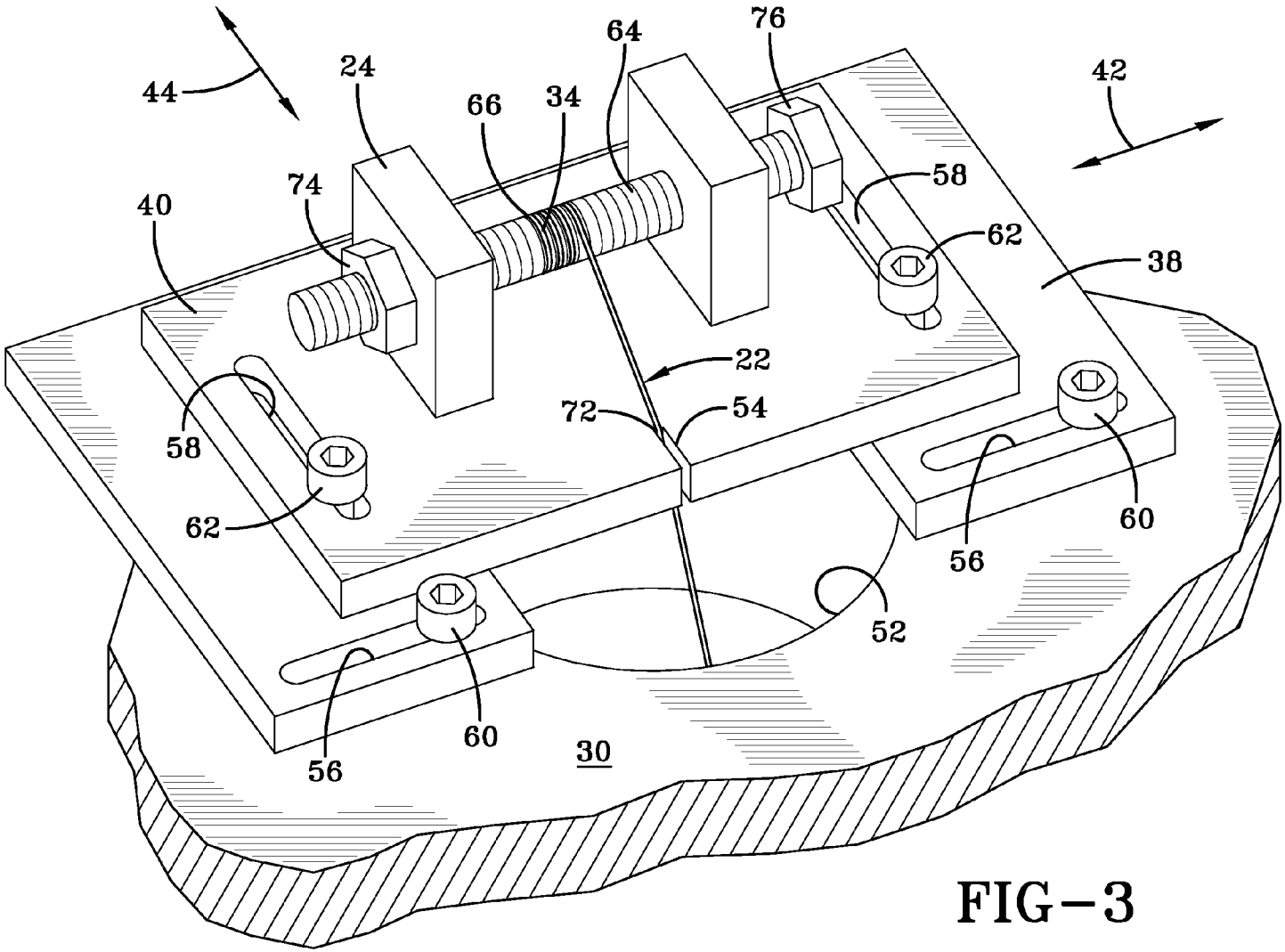
FIG. 3 is an enlarged view of a portion of FIG. 1.
Figure 5:
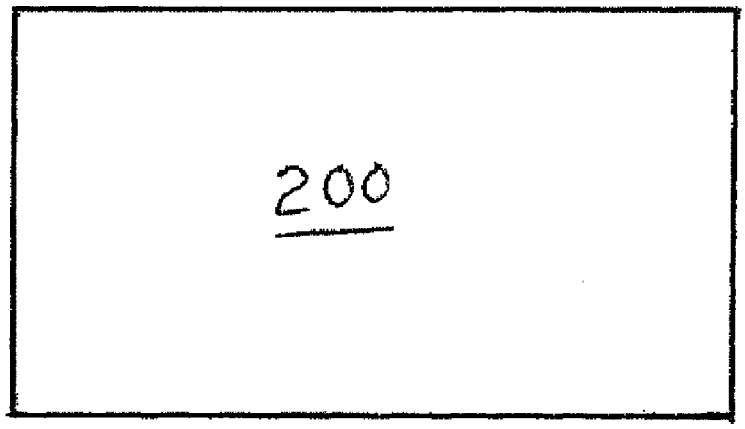
FIG. 5 shows a block diagram of an azimuth measuring means 200 representative of any one of a number of well-known devices, for example, a compass or theodolite which may be utilized in the arrangement of FIG. 1 or of FIG. 4 to obtain a measured value or angle for the azimuth of the tube 12.

FIG. 3 is an enlarged view of the adjusters 38, 40 that are mounted on top plate 30. Top plate 30 contains an aperture 52 through which the flexible member 22 passes. Notch 54 is shown as rectangular, however, other shaped notches may also be used, such as a V-shape. Slots 56, 56 and 58, 58 provide adjustment in the two axes 42, 44 perpendicular to the member 22. Locking screws 60, 60 and 62, 62 secure the position of the tensioner 24 once the adjustments are completed.

FIG. 3 also shows the tensioner 24 that imparts tension to the flexible member 22. Member 22 is guided through a notch 54 and attached at 66 to a threaded shaft 64. The base 72 of notch 54 is a support point for the flexible member 22. Base 72 lies on the longitudinal axis 20 of the centering mandrel 18. Member 22 is tensioned when shaft 64 is rotated. Shaft 64 may be rotated by turning hex head 76. A locking nut 74 may be used to maintain the tension setting.

For calibration, the apparatus 10 may be placed in the bore of a tube or fixture of which the axis is at a known angle of elevation. As an example of calibration, the tube axis will be vertically aligned, that is, the axis is ninety degrees from the horizontal. The flexible member 22 is viewed with a leveled optical instrument of known accuracy, such as a theodolite. The adjuster 38 is used to move the member 22 to the left or right with respect to the line of sight from the optical instrument until the member 22 is coincident with the vertical reticle line of the optical instrument. The apparatus 10 is then rotated 180 degrees about the bore axis and the position of the flexible member 22 is again adjusted left or right (using the adjuster 38) until coincidence of the member 22 and the vertical reticle of the optical instrument is achieved.

Then, the apparatus 10 is rotated 90 degrees about the bore axis and the position of the flexible member 22 is adjusted left or right (using the adjuster 40) until coincidence of the member 22 and the vertical reticle of the optical instrument is achieved. The apparatus 10 is further rotated another 180 degrees about the bore axis and the position of the flexible member 22 is again adjusted left or right (using the adjuster 40) until coincidence of the member 22 and the vertical reticle of the optical instrument is achieved.

To verify that the apparatus 10 has no bias, apparatus 10 may be rotated in the same direction in additional 90 degree increments and the flexible member 22 again checked for coincidence. If a misalignment is now detected, the member 22 may be further adjusted using the adjusters 38, 40. Alternatively, the magnitude of the misalignment of adjuster 38 may be measured via the theodolite, recorded as an azimuth error, and applied as a correction to future measurements.

In operation, the apparatus 10 is placed in the bore 14 of a tube 12. With the tube 12 positioned at the azimuth and elevation of interest, the unique vertical plane that contains the line defined by the flexible member 22 must be determined. This plane may by crudely estimated by eye. That is, at a short distance from the apparatus 10, one may walk circumferentially around apparatus 10 until one reaches a location where the flexible member 22 appears as a vertical line. The unique vertical plane is the plane containing the line defined by member 22 and the point defined as the origin of one's line of sight.

To aid in locating the vertical plane more easily, apparatus 10 may further comprise a plumb bob 68 suspended from a second flexible member 70. Member 70 is also guided through notch 54 and fixed to shaft 64. Member 70 is supported by flexible member 22 at the base 72 of the notch 54. Thus, the azimuth of the tube 12 lies in the vertical plane defined by the two intersecting lines represented by flexible members 22, 70.

Figure 4:
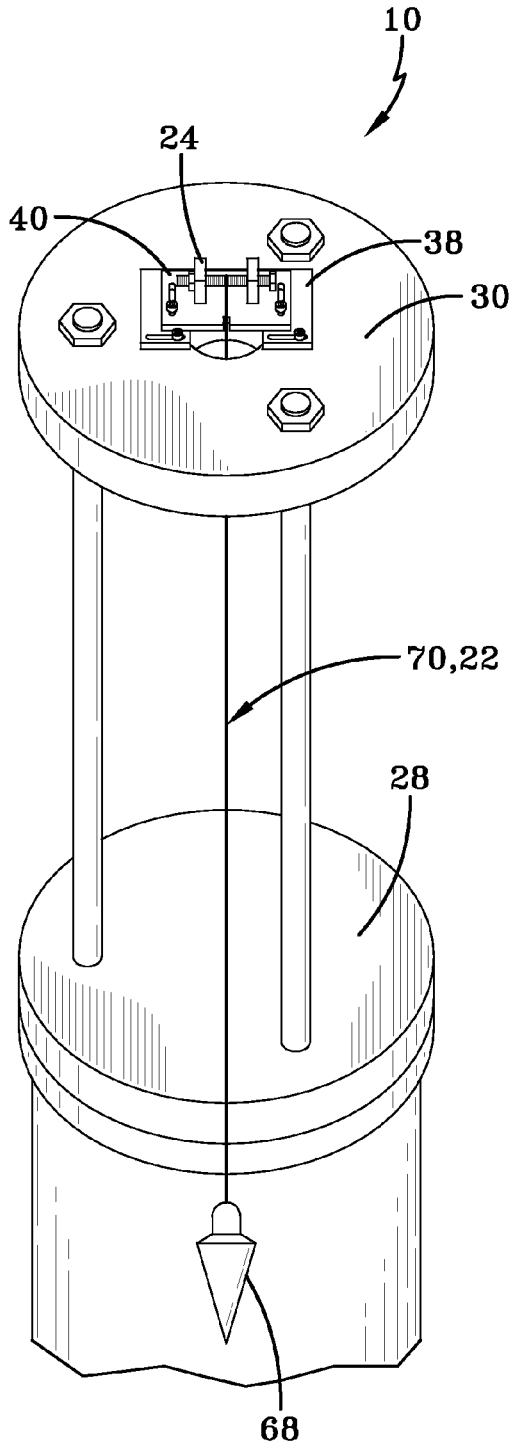
FIG. 4 is a front view of the embodiment of FIG. 1 viewed from a point contained in the vertical plane which also contains the bore axis.

One may take a few steps away from the apparatus, and, using one's line of sight, find a location where the flexible members 22, 70 are coincident, as shown in FIG. 4. For low accuracy measurements of tube azimuth, a compass or other low-resolution azimuth determining device may be positioned on that location and used to measure the azimuth from that location to the tube 12. That value, plus or minus 180 degrees, is the azimuth of the tube 12.

To establish the azimuth of the tube 12 more precisely, an optical instrument such as a theodolite may be positioned on that location to view the coincidence of flexible members 22 and 70, and measure the azimuth to them. Additionally, a theodolite alone, rather than the plumb bob 68 and second flexible member 70, may be used to measure the azimuth. The optical instrument is erected near one's estimation of the location of the vertical plane that contains the member 22. The optical instrument may be moved to the left or right to more precisely align its vertical reticle line with member 22. As with the low-resolution method described above, the value read by the optical instrument, plus or minus 180 degrees, is the azimuth of the tube 12. As an aid in refining the measurement, the apparatus 10 may then be rotated 180 degrees about the bore axis 16. Should the member 22 then be misaligned, the optical instrument may be relocated to reestablish the new azimuth line containing the member 22. The actual azimuth of tube 12 will be the average between the two azimuth measurements.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for measuring an azimuth of a tube having a bore axis, comprising:

a centering mandrel having a longitudinal axis;

a flexible member for defining a bore axis projection of the bore axis;

a tensioner fixed to one end of the flexible member, the tensioner including a support point for the flexible member, the support point lying on a longitudinal axis of the centering mandrel;

a support structure comprising bottom and top plates connected with support members, the tensioner being fixed to the top plate, the centering mandrel being fixed to the bottom plate;

another end of the flexible member being fixed to the bottom plate at a point where the longitudinal axis of the centering mandrel intersects the bottom plate; and a pair of adjusters connected to the tensioner, the adjusters for moving the tensioner along a respective pair of axes that are perpendicular to the bore axis projection, the respective pair of axes of the adjusters being mutually perpendicular.

2. The apparatus of claim 1 wherein the centering mandrel comprises a plurality of lobes.

3. The apparatus of claim 2 wherein at least a portion of each lobe comprises a non-marring material.

4. The apparatus of claim 2 wherein at least two of the plurality of lobes are axially separated on the longitudinal axis of the centering mandrel.

5. The apparatus of claim 2 wherein the plurality of lobes comprises at least three lobes at a same axial location on the longitudinal axis of the centering mandrel.

6. The apparatus of claim 2 wherein at least one of the plurality of lobes includes a spring that holds the lobes against an inner wall of the tube.

7. The apparatus of claim 1 wherein the flexible member comprises one of a cord, string or filament.

8. The apparatus of claim 1 wherein the tensioner comprises a threaded shaft and a locking mechanism.

9. The apparatus of claim 1 wherein each adjuster comprises a plate with a pair of slots formed therein and a respective pair of screws for locking the plate.

10. The apparatus of claim 1 further comprising a second flexible member and a plumb bob, the second flexible member being attached at one end to the tensioner and at another end to the plumb bob.

11. A method of measuring the azimuth of a tube having a bore axis, comprising:

providing the apparatus of claim 10;

inserting the centering mandrel into the tube;

using a line of sight, determining a circumferential location around the apparatus wherein the first and second flexible members coincide;

using an azimuth measuring means, measuring an azimuth from the circumferential location to the tube; and determining the azimuth of the tube by adding 180 degrees to or subtracting 180 degrees from the azimuth measured from the circumferential location to the tube.

12. A method of measuring the azimuth of a tube having a bore axis, comprising:

providing the apparatus of claim 1;

inserting the centering mandrel into the tube;

using a line of sight determining a circumferential location around the apparatus wherein the flexible member appears vertical;

using an azimuth measuring means, measuring an azimuth from the circumferential location to the tube; and determining the azimuth of the tube by adding 180 degrees to or subtracting 180 degrees from the azimuth measured from the circumferential location to the tube.

13. The method of claim 12, further comprising calibrating the apparatus before inserting the central mandrel into the tube.

14. The method of claim 13 wherein calibrating includes inserting the centering mandrel into a tube having a known angle of elevation;

viewing the flexible member with an optical instrument;

using the adjusters, moving the flexible member to coincide with the known angle;

rotating the apparatus 180 degrees in the vertical tube;

viewing the flexible member with the optical instrument; and for a second time, using the adjusters to move the flexible member to coincide with the known angle.

15. The method of claim 14 wherein calibrating further comprises, after using the adjusters the second time, rotating the apparatus 90 degrees in the vertical tube;

viewing the flexible member with the optical instrument; and one of either a) for a third time, using the adjusters to move the flexible member to coincide with the known angle, or b) using the azimuth measuring means, determining an azimuth correction error by measuring a misalignment of the flexible member and the known angle.

16. A method of measuring the azimuth of a tube having a bore axis, comprising:

providing the apparatus of claim 1;

inserting the centering mandrel into the tube;

using an optical instrument having a vertical reference reticle, determining a circumferential location around the apparatus wherein the flexible member coincides with the vertical reference reticle;

using an azimuth measuring means, measuring an azimuth from the circumferential location to the tube; and determining the azimuth of the tube by adding 180 degrees to or subtracting 180 degrees from the azimuth measured from the circumferential location to the tube.

17. The method of claim 16 further comprising, after determining the azimuth of the tube, rotating the apparatus 180 degrees in the tube;

using the optical instrument having the vertical reference reticle, determining a second circumferential location around the apparatus wherein the flexible member coincides with the vertical reference reticle;

using the azimuth measuring means, measuring an azimuth from the second circumferential location to the tube;

determining a second azimuth of the tube by adding 180 degrees to or subtracting 180 degrees from the azimuth measured from the second circumferential location to the tube; and averaging the azimuth determined from claim 16 and the second azimuth.

* * * * *